US007404561B1

(12) United States Patent
Savage

(10) Patent No.: US 7,404,561 B1
(45) **Date of Patent: *Jul. 29, 2008**

(54) LEMONADE STAND PLAYING CARD GAME AND METHOD

(76) Inventor: Clay Savage, 8714 W. Mayo Dr., Crystal River, FL (US) 34429

( * ) Notice: Subject to any disclaimer, the term of this patent is extended or adjusted under 35 U.S.C. 154(b) by 74 days.

This patent is subject to a terminal disclaimer.

(21) Appl. No.: 11/267,677

(22) Filed: Nov. 4, 2005

(51) Int. Cl.
*A63F 1/00* (2006.01)

(52) U.S. Cl. ..... 273/297; 273/292

(58) Field of Classification Search ..... 273/297
See application file for complete search history.

(56) References Cited

U.S. PATENT DOCUMENTS 1,779,584 A * 10/1930 Brown ..... 273/297
2,746,756 A * 5/1956 Sitton, Jr. ..... 273/237
4,134,590 A * 1/1979 Conrad ..... 273/245
4,486,022 A * 12/1984 Dixon ..... 273/256
4,850,595 A * 7/1989 Sherman et al. ..... 273/240
4,900,031 A * 2/1990 Wohl ..... 273/243
5,092,596 A * 3/1992 Bucaria ..... 273/244.2
5,429,371 A * 7/1995 Bledsoe ..... 273/272
6,568,681 B1 * 5/2003 Meyer ..... 273/298
2004/0160003 A1 * 8/2004 Forrest et al. ..... 273/248
2007/0096393 A1 * 5/2007 Gale ..... 273/274

* cited by examiner

*Primary Examiner*—Eugene Kim
*Assistant Examiner*—Dolores R. Collins
(74) *Attorney, Agent, or Firm*—Louis J. Brunoforte

(57) ABSTRACT

A Lemonade Stand playing card game has a box; playing cards and a set of rules and a die, the playing cards including financial cards which constitute the majority of the playing cards and which teach the value of money in business, timing cards which constitute the minority of the playing cards and which teach the value of time in business, and activity cards which constitute less than ten percent of the playing cards and which teach the value of actions in business; a set of rules; and a die.

2 Claims, 2 Drawing Sheets

FIG 5
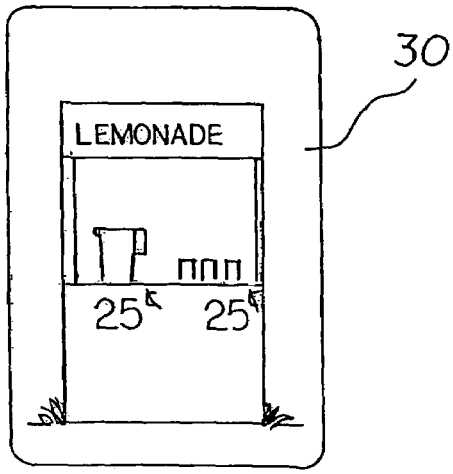
FIG 6
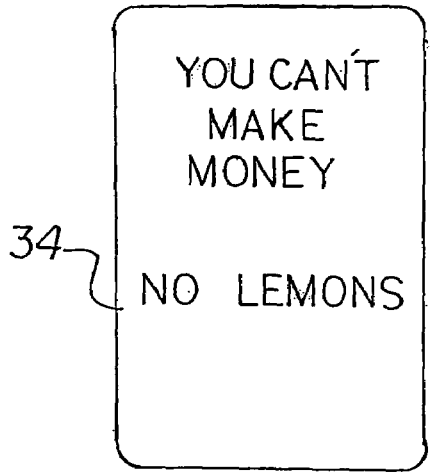
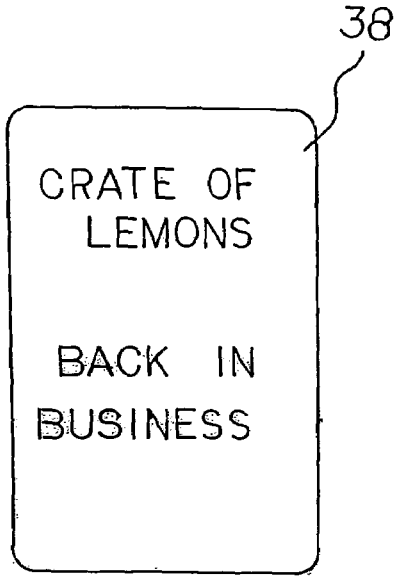
FIG 7
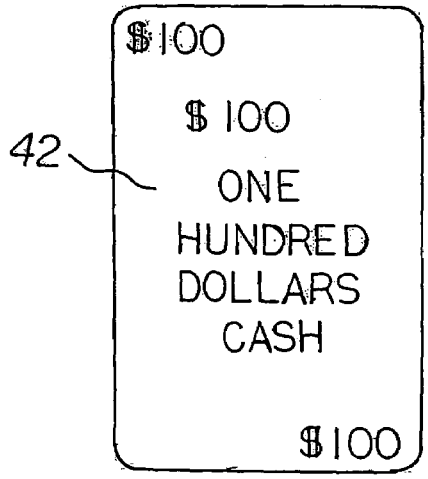
FIG 8

LEMONADE STAND PLAYING CARD GAME AND METHOD

BACKGROUND OF THE INVENTION

1. Field of the Invention

The present invention relates to a Lemonade Stand playing card game and method and more particularly pertains to sharpening card game skills while educating and entertaining players of card games of chance.

2. Description of the Prior Art

The use of card games is known in the prior art. More specifically, card games previously devised and utilized for the purpose of sharpening the skills of card game players and/or entertaining players of cards are known to consist basically of familiar, expected, and obvious structural configurations, notwithstanding the myriad of designs encompassed by the crowded prior art which has been developed for the fulfillment of countless objectives and requirements.

While known devices fulfill their respective, particular objectives and requirements, the aforementioned patents do not describe a Lemonade Stand playing card game that allows sharpening card game skills while educating and entertaining players of card games of chance.

In this respect, the Lemonade Stand playing card game according to the present invention substantially departs from the conventional concepts and designs of the prior art, and in doing so provides an apparatus primarily developed for the purpose of sharpening card game skills while educating and entertaining players of card games of chance.

Therefore, it can be appreciated that there exists a continuing need for a new and improved Lemonade Stand playing card game which can be used for sharpening card game skills while educating and entertaining players of card games of chance. In this regard, the present invention substantially fulfills this need.

SUMMARY OF THE INVENTION

In view of the disadvantages inherent in the known types of card games now present in the prior art, the present invention provides an improved Lemonade Stand playing card game. As such, the general purpose of the present invention, which will be described subsequently in greater detail, is to provide a new and improved Lemonade Stand playing card game and method which has all the advantages of the prior art and none of the disadvantages.

To attain this, the present invention essentially comprises Lemonade Stand playing card game comprising a box for the components, the components including playing cards and a set of rules and a die. Specific playing cards are included. Specific rules are included.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Lemonade Stand playing card game which has all of the advantages of the prior art card games and none of the disadvantages.

It is another object of the present invention to provide a new and improved Lemonade Stand playing card game which may be easily and efficiently manufactured and marketed.

It is further object of the present invention to provide a new and improved Lemonade Stand playing card game which is of reliable constructions.

An even further object of the present invention is to provide a new and improved Lemonade Stand playing card game which is susceptible of a low cost of manufacture with regard to both materials and labor, and which accordingly is then susceptible. of low prices of sale to the consuming public, thereby making such Lemonade Stand playing card game economically available to the buying public.

Even still another object of the present invention is to provide a Lemonade Stand playing card game for sharpening card game skills while educating and entertaining players of card games of chance.

Lastly, it is an object of the present invention to provide a new and improved Lemonade Stand playing card game and method comprising a box; playing cards and a set of rules and a die, the playing cards including financial cards which constitute the majority of the playing cards and which teach the value of money in business, timing cards which constitute the minority of the playing cards and which teach the value of time in business, and activity cards which constitute less than ten percent of the playing cards and which teach the value of actions in business; a set of rules; and a die.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

The invention will be better understood and objects other than those set forth above will become apparent when consideration is given to the following detailed description thereof. Such description makes reference to the annexed drawings wherein:

FIG. 5 is a front elevational view of the back side of each of the cards shown in FIG. 2.

FIG. 6, 7 and 8 are front elevational views of the front side of some of the cards shown in FIGS. 2 and 5.

The same reference numerals refer to the same parts throughout the various Figures.

DESCRIPTION OF THE PREFERRED EMBODIMENT

Figure 1:
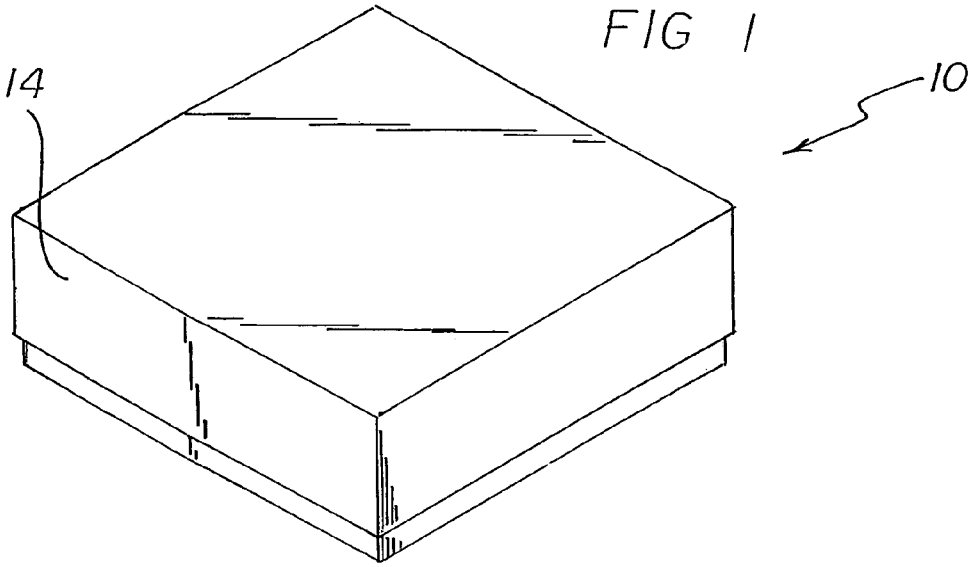
FIG. 1 is a perspective view of a box containing a Lemonade Stand playing card game constructed in accordance with the principles of the present invention.
Figure 2:
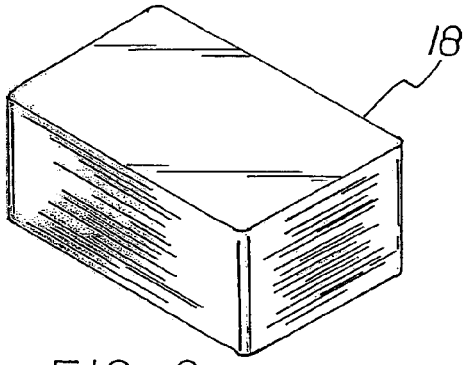
FIG. 2 is a perspective showing of a deck of cards for use in playing the Lemonade Stand playing card game of the present invention.
Figure 4:
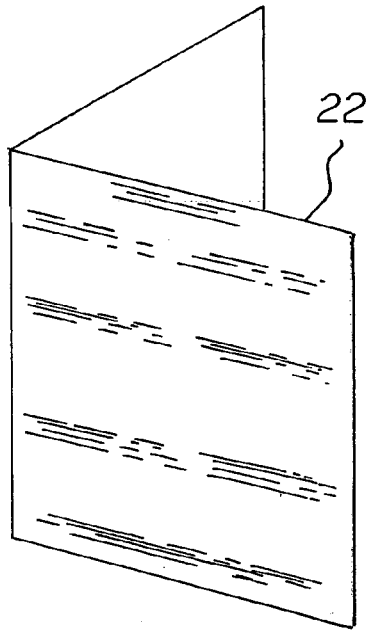
FIG. 4 is a perspective showing of a set of rules for use in playing the Lemonade Stand playing card game of the present invention.
Figure 3:
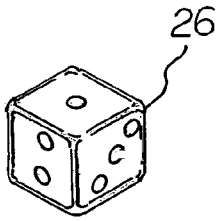
FIG. 3 is a perspective showing of a die for use in playing the Lemonade Stand playing card game of the present invention.

With reference now to the drawings, and in particular to FIG. 1 thereof, the preferred embodiment of the new and improved Lemonade Stand playing card game embodying the principles and concepts of the present invention and generally designated by the reference numeral 10 will be described.

The present invention, the Lemonade Stand playing card game 10 is comprised of a plurality of components. Such components in their broadest context include a box 14, cards 18, rules 22 and a die 26. Such components are individually configured and correlated with respect to each other so as to attain the desired objective.

The back 30 of each card will have a common appearance, as illustrated for example in FIG. 5, preferably reading:

LEMONADE STAND

Playing Card Game showing the name and a small drink stand and homemade sign.

The front of the various cards will include writing which reads, as illustrated for example in FIG. 6 the "LEMONADE STAND" card 30, in FIG. 7 the "YOU CAN'T MAKE MONEY, NO LEMONS" card 34, in FIG. 7 the "CRATE OF LEMONS, BACK IN BUSINESS" card 38 and in FIG. 8 the "$100 ONE HUNDRED DOLLARS CASH" card 42. The front of cards reads as follows:

LEMONADE STAND and $100

ONE HUNDRED DOLLARS CASH and $50

FIFTY DOLLARS CASH and $25

TWENTY-FIVE DOLLARS CASH and $5

FIVE DOLLARS CASH and

PROTECTED $50

PROTECTED and

PROTECTED $25

PROTECTED and

ALL STANDS CLOSED (Stops play)

I Hear the Ice Cream Truck Tune and

YOU CAN'T MAKE MONEY

NO LEMONS and

CRATE OF LEMONS

BACK IN BUSINESS and

YOU CAN'T MAKE MONEY

NO CUPS and

STACK OF CUPS

BACK IN BUSINESS and

YOU CAN'T MAKE MONEY

NO ICE and

BAG OF ICE

BACK IN BUSINESS and

YOU CAN'T MAKE MONEY

NO SUGAR and

POUND OF SUGAR

BACK IN BUSINESS and

I'LL PAY FOR IT

BACK IN BUSINESS and

GIVE ME THE MONEY

Any card from one player and

CAR FULL OF CUSTOMERS

Low Card from each Player

Back in Business and

BUS FULL OF CUSTOMERS

High Card from each player

Back in Business.

The front cover of the box reads the name and a pack of cards with the $100 and $50 cards shown prominently.

The following are financial cards which constitute the majority of the playing cards and which teach the value of money in business and are explained as follows:

Lemonade Stand (12), a Stand card tabled in front of you is necessary to table money cards and protect money cards or play the "All Stands Closed" card, ending the hand;

Money cards: $100 (1), $50 (6), $25 (12), $5 (20);

Protection cards: $50 (2), $25 (6), you can protect amounts up to and including the face value of the protection card, but once placed cannot be moved or added to in any way;

The following are timing cards which can constitute the minority of the playing cars and which teach the value of time in business and are explained as follows:

All Stands Closed (6), can be discarded without effect, but if played by placing card on top of draw deck, stops the hand and can be played by anyone without a "You Can't Make Money" card on their Stand, permitted to play only during last half of the draw deck;

You Can't Make Money cards are split into 4 categories and each "You Can't Make Money" card placed on your Stand card needs a specific "Back in Business" card to resume play, the right "Back in Business" card needs to be drawn or bargained for or play an "I'll Pay For It" card if you have an unprotected tabled money card to discard as payment, playing a "Car Full of Customers" or "Bus Full of Customers" card also removes a "You Can't Make Money" card off your stand getting you back in business, you can place a free "You Can't Make Money" card on someone when you have a "You Can't Make Money" card during the first half of the play deck, placing "You Can't Make Money" cards are free during the second half of the play deck;

You Can't Make Money, No Lemons (3), Crate of Lemons, Back In Business (5);

You Can't Make Money, No Cups (3), Stake of Cups, Back in Business (5);

You Can't Make Money, No Ice (3), Bag of Ice, Back in Business (5);

You Can't Make Money, No Sugar (3), Pound of Sugar, Back in Business (5);

I'll Pay For IT, Back In Business (5), an alternative for those with an unprotected money card tabled, discard with one unprotected money card to remove an "You Can't Make Money" card off your Stand;

The following are activity cars which constitute less than ten percent of the playing cards and which teach the value of activities and action in business and are explained as follows:

Give Me The Money (3), when a person plays this card they can choose one unprotected tabled money card from any one player, this card cannot be played when a "You Can't Make Money" card is on your Stand;

Car Full Of Customer (3), playing this card removes a "You Can't Make Money" card immediately and you collect the lowest unprotected money card from each player;

Bus Full of Customer (1), playing this card removes a "You Can't Make Money" card immediately and you collect the highest unprotected money card from each player; and Stand Builder (1), the player holding this card gets a cut of 10% from each player's net score at the end of the hand added to their score or risks a 50/50 chance of losing any cut by using the dice option, roll a 1, 2, or 3, get 10%, 20%, or 30%, but roll a 4, 5, or 6, get 0%, rolling a 1, 2, or 3 also grants you a re-roll, a re-roll of a 2 is for a 2, 3, or 4 and gets you 20%, 30% or 40%, if, on a re-roll of 2 you roll a 1, 5, or 6 you lose, roll a 4 on a re-roll of a 2 or a 3, not re-roll allowed, take 40%. A re-roll of a 3 is for a 3, 4, or 5, but you lose if you roll a 1, 2, or 6, roll a 5 on a re-roll of a 3 and you get 50% of all player' totals that hand.

The rules include steps as follows:

Shuffle and deal, face down, six cards to each player.

Place the deck face down in the middle of the table and cut the pack and remove one half of the deck, the person to the left of the dealer draws first.

First table a Lemonade Stand card by placing the card in front of you on the table.

On the next turn, table the lowest money card in your hand onto the table.

Each time you draw, you must table money or protect money cards, discard, or play any of the other cards explained below.

To discard, place card next to pick up deck.

Once discarded, a card cannot be picked up front the discard pile.

Each player takes a turn, each tabling a Stand card until someone who does not have a Stand can offer a money card from their hand and trade it with a player with an extra Lemonade Stand card.

Any player can initiate a trade with the player whose turn it is, about to draw from the deck or is holding 7 cards, a deal can be for any card for any reason.

At the end of each turn all players must have 6 cards, money cards count for you if you put them on the table, only the highest money card retained in your hand counts against your score.

At the end of a hand, each player takes a turn counting out loud to the person keeping score their total score by subtracting the highest money card in their hand from their total money down.

The score keeper deducts ten percent from every playing and adds that amount to the player holding the Stand Builder card, if not discarded earlier in the game or changed by the dice option.

The scoring if the dice option is used is to reduce each score by the percent won, the best way to calculate this is with an amount of 10%, moving the decimal to the left one digit, i.e., 150=15, double that amount for 20%, tripling it for 30%, doubling the 10% and doubling it again for 40%, cut in half the total score of each player for calculating 50%, add all of the amounts to the Stand Builder's score.

A game is by hands or an amount, for example, the first to reach one thousand dollars wins.

The present invention also includes the method of playing the game. The method includes providing a box for the components, the components including playing cards and a set of rules and a die. The writing on the cards includes:

LEMONADE STAND and $100

ONE HUNDRED DOLLARS CASH and $50

FIFTY DOLLARS CASH and $25

TWENTY-FIVE DOLLARS CASH and $5

FIVE DOLLARS CASH and

PROTECTED $50

PROTECTED and

PROTECTED $25

PROTECTED and

ALL STANDS CLOSED (Stops play)

I Hear the Ice Cream Truck Tune and

YOU CAN'T MAKE MONEY

NO LEMONS and

CRATE OF LEMONS

BACK IN BUSINESS and

YOU CAN'T MAKE MONEY

NO CUPS and

STACK OF CUPS

BACK IN BUSINESS and

YOU CAN'T MAKE MONEY

NO ICE and

BAG OF ICE

BACK IN BUSINESS and

YOU CAN'T MAKE MONEY

NO SUGAR and

POUND OF SUGAR

BACK IN BUSINESS and

I'LL PAY FOR IT

BACK IN BUSINESS and

GIVE ME THE MONEY

Any card from one player and

CAR FULL OF CUSTOMERS

Low Card from each Player

Back in Business and

BUS FULL OF CUSTOMERS

High Card from each player

Back in Business.

Explaining the cars as follows:

Lemonade Stand (12), a Stand card tabled in front of you is necessary to table money cards and protect money cards or play the "All Stands Closed" card, ending the hand;

Money cards: $100 (1), $50 (6), $25 (12), $5 (20);

Protection cards: $50 (2), $25 (6), you can protect amounts up to and including the face value of the protection card, but once placed cannot be moved or added to in any way;

The following are timing cards which can constitute the minority of the playing cars and which teach the value of time in business and are explained as follows:

All Stands Closed (6), can be discarded without effect, but if played by placing card on top of draw deck, stops the hand and can be played by anyone without a "You Can't Make Money" card on their Stand, permitted to play only during last half of the draw deck; 3

You Can't Make Money cards are split into 4 categories and each "You Can't Make Money" card placed on your Stand card needs a specific "Back in Business" card to resume play, the right "Back in Business" card needs to be drawn or bargained for or play an "I'll Pay For It" card if you have an unprotected tabled money card to discard as payment, playing a "Car Full of Customers" or "Bus Full of Customers" card also removes a "You Can't Make Money" card off your stand getting you back in business, you can place a free "You Can't Make Money" card on someone when you have a "You Can't Make Money" card during the first half of the play deck, placing "You Can't Make Money" cards are free during the second half of the play deck;

You Can't Make Money, No Lemons (3), Crate of Lemons, Back In Business (5);

You Can't Make Money, No Cups (3), Stake of Cups, Back in Business (5);

You Can't Make Money, No Ice (3), Bag of Ice, Back in Business (5);

You Can't Make Money, No Sugar (3), Pound of Sugar, Back in Business (5);

I'll Pay For IT, Back In Business (5), an alternative for those with an unprotected money card tabled, discard with one unprotected money card to remove an "You Can't Make Money" card off your Stand;

Give Me The Money (3), when a person plays this card they can choose one unprotected tabled money card from any one player, this card cannot be played when a "You Can't Make Money" card is on your Stand;

Car Full Of Customer (3), playing this card removes a "You Can't Make Money" card immediately and you collect the lowest unprotected money card from each player;

Bus Full of Customer (1), playing this card removes a "You Can't Make Money" card immediately and you collect the highest unprotected money card from each player; and Stand Builder (1), the player holding this card gets a cut of 10% from each player's net score at the end of the hand added to their score or risks a 50/50 chance of losing any cut by using the dice option, roll a 1, 2, or 3, get 10%, 20%, or 30%, but roll a 4, 5, or 6, get 0%, rolling a 1, 2, or 3 also grants you a re-roll, a re-roll of a 2 is for a 2, 3, or 4 and gets you 20%, 30% or 40%, if, on a re-roll of 2 you roll a 1, 5, or 6 you lose, roll a 4 on a re-roll of a 2 or a 3, not re-roll allowed, take 40%. A re-roll of a 3 is for a 3, 4, or 5, but you lose if you roll a 1, 2, or 6, roll a 5 on a re-roll of a 3 and you get 50% of all player' totals that hand; and following the steps of the rules as follows:

shuffle and deal, face down, six cards to each player;

place the deck face down in the middle of the table and cut the pack and remove one half of the deck, the person to the left of the dealer draws first;

first table a Lemonade Stand card by placing the card in front of you on the table;

on the next turn, table the lowest money card in your hand onto the table;

each time you draw, you must table money or protect money cards, discard, or play any of the other cards explained below;

to discard, place card.next to pick up deck;

once discarded, a card cannot be picked up front the discard pile;

each player takes a turn, each tabling a Stand card until someone who does not have a Stand can offer a money card from their hand and trade it with a player with an extra Lemonade Stand card;

any player can initiate a trade with the player whose turn it is, about to draw from the deck or is holding 7 cards, a deal can be for any card for any reason;

at the end of each turn all players must have 6 cards, money cards count for you if you put them on the table, only the highest money card retained in your hand counts against your score.

at the end of a hand, each player takes a turn counting out loud to the person keeping score their total score by subtracting the highest money card in their hand from their total money down;

the score keeper deducts ten percent from every playing and adds that amount to the player holding the Stand Builder card, if not discarded earlier in the game or changed by the dice option;

the scoring if the dice option is used is to reduce each score by the percent won, the best way to calculate this is with an amount of 10%, moving the decimal to the left one digit, i.e., 150=15, double that amount for 20%, tripling it for 30%, doubling the 10% and doubling it again for 40%, cut in half the total score of each player for calculating 50%, add all of the amounts to the Stand Builder's score; and a game is by hands or an amount, for example, the first to reach one thousand dollars wins.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A Lemonade Stand playing card game comprising a box for the components, the components including playing cards and a set of rules and a die, the playing cards including financial cards which constitute the majority of the playing cards and which teach the value of money in business, the playing cards also including timing cards which constitute the minority of the playing cards and which teach the value of time in business, the playing cards also including activity cards which constitute less than ten percent of the playing cards and which teach the value of actions in business wherein the rules include the steps of:

dealing as follows:

shuffling and dealing, face down, six cards to each player;

placing the deck face down in the middle of the table;

cutting the pack; and removing one half of the deck;

commencing play as follows:

a player to the left of the dealer drawing first;

First a player tabling a Lemonade Stand card by placing the card in front of the player on the table;

On the next turn, the player tabling the lowest money card in the player's hand onto the table;

Each time a player draws, the player must table money or protect money cards, discard, or play any of the other cards explained below;

To discard, placing a card next to pick up deck; once discarded, a card cannot be picked up front the discard pile;

continuing play as follows:

Each player taking a turn, each tabling a Stand card until a player who does not have a Stand can offer a money card from their hand and trade it with a player with an extra Lemonade Stand card;

Any player can initiate a trade with the player whose turn it is, about to draw from the deck or is holding 7 cards, a deal can be for any card for any reason;

At the end of each turn all players must have 6 cards, money cards count for a player if the player puts them on the table, only the highest money card retained in his hand counts against a player's score;

scoring the end of each hand as follows:

At the end of a hand, each player taking a turn counting out loud to a score keeper their total score by subtracting the highest money card in their hand from their total money down;

The score keeper deducting ten percent from every player and adding that amount to the player holding the Stand Builder card, if not discarded earlier in the game or changed by the dice option;

alternatively scoring the end of a hand as follows:

scoring if the dice option is used is to reduce each score by the percent won, the best way to calculate this is with an amount of 10%, moving the decimal to the left one digit, i.e., 150=15, double that amount for 20%, tripling it for 30%, doubling the 10% and doubling it again for 40%, cut in half the total score of each player for calculating 50%, add all of the amounts to the Stand Builder's score;

and ending the same as follows:

A game is by hands or an amount, for example, the first player to reach one thousand dollars wins.

2. A Lemonade Stand playing card game comprising the steps of:

providing a box for the components, the components including playing cards and a set of rules and a die, die, the writing on the cards including:

LEMONADE STAND
and
$100
ONE HUNDRED DOLLARS CASH
and
$50
FIFTY DOLLARS CASH
and
$25
TWENTY-FIVE DOLLARS CASH
and
$5
FIVE DOLLARS CASH
and
PROTECTED
$50
PROTECTED
and
PROTECTED
$25
PROTECTED
and
ALL STANDS CLOSED
(Stops Play)
I Hear the Ice Cream Truck Tune
and
YOU CAN'T MAKE MONEY
NO LEMONS
and
CRATE OF LEMONS
BACK IN BUSINESS
and
YOU CAN'T MAKE MONEY
NO CUPS
and
STACK OF CUPS
BACK IN BUSINESS
and
YOU CAN'T MAKE MONEY
NO ICE
and
BAG OF ICE
BACK IN BUSINESS
and
YOU CAN'T MAKE MONEY
NO SUGAR
and
POUND OF SUGAR
BACK IN BUSINESS
and
I'LL PAY FOR IT
BACK IN BUSINESS
and GIVE ME THE MONEY
ANY CARD FROM ONE PLAYER
and
CAR FULL OF CUSTOMERS
LOW CARD FROM EACH PLAYER
BACK IN BUSINESS
and
BUS FULL OF CUSTOMERS
HIGH CARD FROM EACH PLAYER
BACK IN BUSINESS Explaining the cards as follows:

The following are financial cards which constitute the majority of the playing cards and which teach the value of money in business:

Lemonade Stand (12), a Stand card tabled in front of you is necessary to table money cards and protect money cards or play the "All Stands Closed" card, ending the hand;

Money cards: $100 (1), $50 (6), $25 (12), $5 (20);

Protection cards: $50 (2), $25 (6), you can protect amounts up to and including the face value of the protection card, but once placed cannot be moved or added to in any way;

The following are timing cards which can constitute the minority of the playing cars and which teach the value of time in business:

All Stands Closed (6), can be discarded without effect, but if played by placing card on top of draw deck, stops the hand and can be played by anyone without a "You Can't Make Money" card on their Stand, permitted to play only during last half of the draw deck;

You Can't Make Money cards are split into 4 categories and each "You Can't Make Money" card placed on your Stand card needs a specific "Back in Business" card to resume play, the right "Back in Business" card needs to be drawn or bargained for or play an "I'll Pay For It" card if you have an unprotected tabled money card to discard as payment, playing a "Car Full of Customers" or "Bus Full of Customers" card also removes a "You Can't Make Money" card off your stand getting you back in business, you can place a free "You Can't Make Money" card on someone when you have a "You Can't Make Money" card during the first half of the play deck, placing "You Can't Make Money" cards are free during the second half of the play deck;

You Can't Make Money, No Lemons (3), Crate of Lemons, Back In Business (5);

You Can't Make Money, No Cups (3), Stake of Cups, Back in Business (5);

You Can't Make Money, No Ice (3), Bag of Ice, Back in Business (5);

You Can't Make Money, No Sugar (3), Pound of Sugar, Back in Business (5);

I'll Pay For IT, Back In Business (5), an alternative for those with an unprotected money card tabled, discard with one unprotected money card to remove an "You Can't Make Money" card off your Stand;

The following are activity cards which constitute less than ten percent of the playing cards and which teach the value of activities and action in business:

Give Me The Money (3), when a person plays this card they can choose one unprotected tabled money card from any one player, this card cannot be played when a "You Can't Make Money" card is on your Stand;

Car Full Of Customer (3), playing this card removes a "You Can't Make Money" card immediately and you collect the lowest unprotected money card from each player;

Bus Full of Customer (1), playing this card removes a "You Can't Make Money" card immediately and you collect the highest unprotected money card from each player; and Stand Builder (1), the player holding this card gets a cut of 10% from each player's net score at the end of the hand added to their score or risks a 50/50 chance of losing any cut by using the dice option, roll a 1, 2, or 3, get 10%, 20%, or 30%, but roll a 4, 5, or 6, get 0%, rolling a 1, 2, or 3 also grants you a re-roll, a re-roll of a 2 is for a 2, 3, or 4 and gets you 20%, 30% or 40%, if, on a re-roll of 2 you roll a 1, 5, or 6 you lose, roll a 4 on a re-roll of a 2 or a 3, not re-roll allowed, take 40%; A re-roll of a 3 is for a 3, 4, or 5, but you lose if you roll a 1, 2, or 6, roll a 5 on a re-roll of a 3 and you get 50% of all player' totals that hand; and following the steps of the rules as follows:

dealing as follows:

shuffling and dealing, face down, six cards to each player;

placing the deck face down in the middle of the table;

cutting the pack; and removing one half of the deck; the commencing play as follows:

a player to the left of the dealer drawing first;

First a player tabling a Lemonade Stand card by placing the card in front of the player on the table;

On the next turn, the player tabling the lowest money card in the player's hand onto the table;

Each time a slayer draws, the player must table money or protect money cards, discard, or play any of the other cards explained below;

To discard, placing a card next to pick up deck; once discarded, a card cannot be picked up front the discard pile;

continuing play as follows:

Each player taking a turn, each tabling a Stand card until a player who does not have a Stand can offer a money card from their hand and trade it with a player with an extra Lemonade Stand card;

Any player can initiate a trade with the player whose turn it is, about to draw from the deck or is holding 7 cards, a deal can be for any card for any reason;

At the end of each turn all players must have 6 cards, money cards count for a player if the slayer puts them on the table, only the highest money card retained in his hand counts against a player's score;

scoring the end of each hand as follows:

At the end of a hand, each player taking a turn counting out loud to a score keeper their total score by subtracting the highest money card in their hand from their total money down; The score keeper deducting ten percent from every player and adding that amount to the player holding the Stand Builder card, if not discarded earlier in the game or changed by a dice option;

alternatively scoring the end of a hand as follows:

Scoring if the dice option is used is to reduce each score by the percent won, the best way to calculate this is with an amount of 10%, moving the decimal to the left one digit, i.e., 150=15, double that amount for 20%, tripling it for 30%, doubling the 10% and doubling it again for 40%, cut in half the total score of each player for calculating 50%, add all of the amounts to the Stand Builder's score;

and ending the game as follows:

A game is by hands or an amount, for example, the first player to reach one thousand dollars wins.

* * * * *